US012521640B2

(12) United States Patent
Zamperla et al.

(10) Patent No.: US 12,521,640 B2
(45) Date of Patent: Jan. 13, 2026

(54) SEAT FOR AMUSEMENT RIDES AND SYSTEM FOR THE BOARDING/DISEMBARKING OF PASSENGERS ON/FROM AT LEAST ONE SEAT

(71) Applicant: ANTONIO ZAMPERLA S.p.A., Altavilla Vicentina (IT)

(72) Inventors: Alberto Zamperla, Altavilla Vicentina (IT); Massimo Romanaldi, Altavilla Vicentina (IT); Albano Moresco, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 796 days.

(21) Appl. No.: 17/782,718

(22) PCT Filed: Dec. 4, 2020

(86) PCT No.: PCT/IB2020/061509
§ 371 (c)(1),
(2) Date: Jun. 6, 2022

(87) PCT Pub. No.: WO2021/111395
PCT Pub. Date: Jun. 10, 2021

(65) Prior Publication Data

US 2023/0045857 A1 Feb. 16, 2023

(30) Foreign Application Priority Data

Dec. 6, 2019 (IT) ..... 102019000023301

(51) Int. Cl.
*A63G 9/00* (2006.01)
*A63G 31/02* (2006.01)

(52) U.S. Cl.
CPC ..... *A63G 31/02* (2013.01); *A63G 9/00* (2013.01)

(58) Field of Classification Search
CPC ..... A47C 9/002
See application file for complete search history.

(56) References Cited

U.S. PATENT DOCUMENTS 83,216 A * 10/1868 Shaffer ..... A63G 9/20 472/120
185,353 A * 12/1876 Rogers ..... A63G 9/16 472/124

(Continued)

FOREIGN PATENT DOCUMENTS

JP 2006034396 A1 2/2006
WO 9702878 A1 1/1997

(Continued)

OTHER PUBLICATIONS

International search report and written opinion issued by the EPO on May 26, 2021 for PCT/IB2020/061509.

*Primary Examiner* — Morgan T Jordan
(74) *Attorney, Agent, or Firm* — Rivka Friedman

(57) ABSTRACT

A seat for amusement rides which has a seat portion and a backrest to accommodate a passenger, and a footboard and a leg rest element configured in use to provide support respectively for the foots and the legs of the passenger. The seat also has jutting elements which jut from a front edge of the seat portion, and a supporting frame which is constrained, in a removable manner, to the seat portion by means of the jutting elements and supports the footboard and the leg rest element.

17 Claims, 13 Drawing Sheets

(56) References Cited

U.S. PATENT DOCUMENTS 213,150 A * 3/1879 Unzicker ..... A63G 9/16 472/122
364,182 A * 5/1887 Lyon ..... A47C 7/66 472/121
403,914 A * 5/1889 Carmody ..... A47C 3/0255 472/123
482,217 A * 9/1892 Alexander et al. ..... A63G 9/20 472/120
485,630 A * 11/1892 Hull ..... A01K 13/006 119/862
847,997 A * 3/1907 Arney ..... A63G 11/00 472/5
1,068,472 A * 7/1913 Whitman et al. ..... A63G 1/18 472/23
1,083,387 A * 1/1914 Cohee ..... A63G 9/16 472/124
1,259,649 A * 3/1918 McGuire ..... A63G 9/20 472/120
1,434,434 A * 11/1922 Eycleshymer ..... A47D 13/105 472/121
1,615,241 A * 1/1927 Smedberg ..... A63G 9/00 472/121
1,620,448 A * 3/1927 Dourdoufis ..... A47C 7/029 297/423.38
1,641,953 A * 9/1927 Abraham ..... A47D 1/103 297/130
1,680,970 A * 8/1928 Dahl ..... A63G 9/02 472/121
2,048,110 A * 7/1936 Fry ..... A47D 13/105 472/120
2,200,881 A * 5/1940 Fry ..... A47C 3/0255 472/124
2,685,915 A * 8/1954 Hannas ..... A63G 9/00 472/108
3,171,653 A * 3/1965 Pacuk ..... A63G 9/16 472/120
3,286,708 A * 11/1966 Gartner ..... A47C 9/002 5/915
3,883,136 A * 5/1975 Kim ..... A63G 9/16 446/322
4,134,583 A * 1/1979 Davidson ..... A63B 69/12 482/19
4,226,467 A * 10/1980 Boudreau ..... A47D 13/101 472/110
4,456,244 A * 6/1984 Andrews ..... A63G 9/00 472/125
4,986,600 A * 1/1991 Leblanc ..... B60N 2/3084 297/238
5,161,522 A * 11/1992 Clevenger ..... A61G 5/1091 601/24
5,472,260 A * 12/1995 Czapski ..... B60N 2/3084 297/238
5,564,780 A * 10/1996 Presser ..... B60N 2/3047 297/238
5,665,002 A * 9/1997 Balwanz ..... A63G 9/00 472/133
5,842,741 A * 12/1998 Onorini ..... A47C 3/0255 472/125
5,897,462 A * 4/1999 St. Germain ..... A61G 5/0858 482/130
5,931,740 A * 8/1999 Kitchen ..... A63G 9/00 472/133
5,938,283 A * 8/1999 Babcock ..... A63G 9/02 297/278
6,110,048 A * 8/2000 Murray ..... A63G 9/08 472/16
6,773,064 B2 * 8/2004 Treen ..... A47D 1/103 297/255
6,884,177 B2 * 4/2005 Zambelli ..... A63G 21/04 104/53
6,929,553 B1 * 8/2005 Diemert ..... A63G 9/00 472/121
7,476,188 B2 * 1/2009 Perez, Jr. ..... A63B 23/0211 482/142
10,258,893 B2 * 4/2019 Freedman ..... A63G 1/00
10,456,695 B1 10/2019 Henley
11,058,962 B1 * 7/2021 Henley ..... A63G 27/04
11,110,877 B2 * 9/2021 Caelen ..... A63G 7/00
2003/0075966 A1 4/2003 Behnert
2005/0001466 A1 * 1/2005 Zambelli ..... A47C 7/54 297/464
2007/0199474 A1 * 8/2007 Zamperla ..... A63G 21/20 104/53
2008/0081706 A1 * 4/2008 Zamperla ..... A63G 7/00 472/44
2008/0143158 A1 * 6/2008 Roodenburg ..... A63G 7/00 297/484
2009/0269175 A1 10/2009 Rose et al.
2010/0066111 A1 3/2010 Fritsche et al.
2010/0236444 A1 9/2010 Blonk et al.
2012/0077653 A1 * 3/2012 Dedov ..... A63B 21/4047 482/139
2013/0337925 A1 * 12/2013 Hsu ..... A63G 9/00 472/125
2016/0037925 A1 * 2/2016 Yen ..... A63B 21/068 297/325
2016/0220910 A1 * 8/2016 Zamperla ..... A63G 7/00
2016/0296390 A1 10/2016 Rebbie et al.
2017/0312641 A1 * 11/2017 Zamperla ..... A63G 1/16
2018/0085676 A1 * 3/2018 Zamperla ..... A63G 7/00
2023/0045857 A1 * 2/2023 Zamperla ..... A63G 7/00

FOREIGN PATENT DOCUMENTS

WO 9746476 A1 12/1997
WO WO-2008059356 A2 * 5/2008 ..... A63G 1/10

* cited by examiner

SEAT FOR AMUSEMENT RIDES AND SYSTEM FOR THE BOARDING/DISEMBARKING OF PASSENGERS ON/FROM AT LEAST ONE SEAT

This application is a U.S. national stage of PCT/IB2020/061509 filed on 4 Dec. 2020, which claims priority to and the benefit of Italian Patent Application No. 102019000023301, filed 6 Dec. 2019 the contents of which are incorporated herein by reference in their entireties.

FIELD OF THE INVENTION

The present invention generally relates to the field of amusement rides (known in the art also as amusement apparatus) and, more specifically, to a seat, a system and a method to allow a passenger with physical disability to use an amusement ride.

It should be noted from the outset that the seat and the system according to the invention can be used in amusement rides of different types and in which the seat can make several movements.

KNOWN PRIOR ART

Amusement rides, used for example in funfairs and theme parks, comprise vehicles with one or more seats on which passengers can be accommodated before the vehicles are moved.

Passengers are carried inside vehicles equipped with one or more seats, which are subject to forces and accelerations, which make it necessary to provide restraining devices to safely retain passengers, by securing them firmly and effectively to their own seats when the amusement ride is moving.

The restraining devices are designed to prevent passengers from losing contact with the seat, thereby sliding or falling as a result of the action exerted by the forces and accelerations they are subjected to, and also to prevent passengers from making undesirable or dangerous movements, e.g. inadvertent head and neck movements due to the action of the forces they are subjected to.

A restraining device has to effectively restrain the passengers without being too constricting.

The amusement rides of funfairs may comprise vehicles and/or seats in which passengers have their lower limbs suspended in the void, for example, but not limited to, roller coasters of the "inverted coaster" or "suspended coaster" type, or else of the "floorless coaster" type, or certain amusement rides of pendulum type or having swinging motion type around an axle, in which vehicles equipped with seats carrying passengers are suspended on a swing arm.

Amusement rides where the seats can be stably mounted on a platform are also known, in these cases there is contact of the passenger's feet with the platform below.

The passenger is then accommodated on the seats of such amusement rides so that he or she has at least part of his or her lower limbs suspended in the void, or so that the passenger has his or her feet resting on a platform on which the seat is placed, while still allowing the passenger to move his or her lower limbs.

As known, amusement rides are often constructed so that passengers are subjected to strong accelerations, for example they may be constructed so that vehicles and/or seats move along complex tracks, which comprise curved and/or straight portions, or so that they are subjected to swinging movements.

Due to accelerations and forces caused by amusement rides on passengers, restraining devices have to be provided in order to secure passengers when the amusement ride is moving.

Such known devices comprise a restraining element, e.g. a bar, which is movable between an open position and a closed position of the restraining device, to secure the passenger to the seat. The movable bar is brought into contact with the passenger's thighs, for example, or placed close to the passenger's thighs or abdominal area by rotating the restraining device.

In such devices the passenger is secured to the seat so that at least part of the lower limbs is suspended in the void, and the lower limbs are at least partially free to move.

Because of this feature, the use of many amusement rides is precluded for people with physical disabilities that involve damage to the lower limbs or the inability to move them, e.g. a complete or partial loss of the ability to move the legs (paralysis), for example due to muscular atrophy, or damage to the spinal cord.

In fact, a person who has suffered a complete or partial loss of the ability to move the legs (for example paralysis), or who is forced to the immobility of at least part of a lower limb, cannot perform any control of his/her lower limbs and therefore, for example, during the operation of the amusement ride would not be able to resist the forces and accelerations he/she is subjected to.

In this regard, amusement rides have been developed in which passengers with physical disabilities involving the lower limbs, so that they are forced to use a wheelchair (also named as chair with wheels hereinafter), can be safely boarded on the amusement ride. Passengers can be boarded with their own wheelchair, which is secured to the platform of the amusement ride, or to a specific platform, by means of retaining devices, such as for example belts or straps.

The passenger has to be additionally secured to his or her wheelchair, for example by means of an additional restraining device of known type comprising a movable bar or through additional belts.

A drawback resulting from the known art is the complexity and lack of versatility of the restraining devices for seats for passengers with physical disabilities.

In fact, in amusement rides of known type, the platforms must be made providing restraining means adapted to effectively constrain both the wheels of a wheelchair to the platform and the passenger himself to his/her own wheelchair.

Due to this configuration, the restraining means can neither be tailored to the size of the wheelchair nor to the size of the passenger himself/herself.

As a matter of fact, known restraining devices are designed and dimensioned to constrain wheelchairs of standard size and shape, and passengers of standard size and weight, i.e. standard height and weight, so that known devices cannot be easily tailored to different wheelchairs and passengers.

In addition, the restraining element of known restraining devices may be locked in an incorrect position, i.e. a position where there is a gap between the restraining element and the wheelchair or between the restraining element and the passenger.

A further drawback of amusement rides of known type is that the height where the passenger boarding platforms are located is higher or lower than the height where the platform to which the seats are constrained is located.

A person with physical disability, in particular a person confined to a wheelchair, is unable to autonomously board on or disembark from the vehicle or seat of the amusement ride. The maneuver must necessarily be assisted and can be very difficult and dangerous, as well as unpleasant for the passenger.

Therefore, the drawbacks complained of in the use of amusement rides of known type have yet to be overcome, and an amusement ride and in particular an amusement-ride seat adapted to secure a passenger with physical disabilities in a safe, effective and comfortable way has yet to be provided.

Furthermore, it is an object of the present invention to make a seat for amusement rides to accommodate at least one passenger, which comprises restraining means that can be tailored to the characteristics of a passenger, in particular the physical characteristics of his/her lower limbs.

It is a further object of the present invention to make an amusement-ride seat to accommodate at least one passenger, which comprises restraining means that are effective and safe to use, as well as easy to install, repair or replace.

It is a further object of the present invention to make a system for the boarding/disembarking of passengers on/from an amusement ride seat that is easy to use for an operator during the boarding operation of a passenger with physical disabilities.

It is a further object of the present invention to make a system for the boarding/disembarking of passengers on/from an amusement ride seat that is versatile and can be used with passengers having different physical characteristics of weight and height.

It is a further object of the present invention to make a system for the boarding/disembarking of passengers on/from an amusement ride seat that can be used in different types of amusement rides.

It is a further object of the present invention to make a system for the boarding/disembarking of passengers on/from an amusement ride seat that guarantees stability to the passenger and the operator during the boarding/disembarking operation of the passenger.

SUMMARY OF THE INVENTION

These and other objects are achieved by means of a seat for amusement rides according to the present invention.

The amusement-ride seat according to the present invention comprises a seat portion and a backrest to accommodate at least one passenger, and in particular a disabled passenger. The seat comprises at least one footboard and/or at least one leg rest element configured in use to provide support respectively for at least one foot and at least one leg of the passenger.

Preferably the seat further comprises restraining means configured to secure the passenger's foot and/or leg to the at least one footboard and/or at least one leg rest element (thus preventing the limbs from moving away from the footboard and leg rest). Advantageously, thanks to the presence of a footboard and/or a leg rest element and preferably respective restraining means (such as a strap or band, or a restraining surface) to secure the foot or leg to the respective footboard and leg rest element, respectively, the lower limbs of the passenger, and in particular the disabled passenger, can be secured during the movement of the amusement ride, thus preventing their unwanted movements.

According to an aspect, the footboard and/or leg rest element is removably constrained to the seat. This aspect advantageously allows this element to be installed only when there is a need to support the passenger's lower limbs, for example when the seat is used by a disabled passenger.

According to an aspect, the seat comprises reversible-type constraining means to constrain at least one footboard and/or at least one leg rest element to the seat, preferably said constraining means being of a type of interference of parts, interlocking of parts, or shape-coupling, or a combination thereof. According to an aspect, the constraining means comprise at least one substantially tubular element (e.g. shaped as a sleeve) jutting from said seat.

By doing so, connecting means that allow the footboard and/or leg rest element to be quickly and easily installed/removed can be provided without jeopardizing the aesthetics of the seat.

According to an aspect, the footboard and/or leg rest element comprises at least one coupling portion which cooperates, preferably in a reversible manner, with said constraining means of the seat in order to quickly and easily perform the connection.

According to an aspect, the constraining means of the seat are adapted for receiving, or hooking, at least part of the at least one coupling portion, or vice versa. By doing so, the connection is quick and easy as well as very safe and effective.

According to an aspect, the footboard and/or leg rest element comprises a supporting frame which is constrained, preferably in a removable manner, to the seat. Preferably, the supporting frame comprises a fixed portion configured to be constrained, preferably in a removable manner, to the seat and a movable portion able to be moved with respect to the fixed portion, the footboard and/or the leg rest element being arranged on the movable portion of the supporting frame.

Advantageously, the supporting frame allows the footrest and/or leg rest elements to be quickly and easily connected to the seat, for example by cooperating with the constraining means the seat is equipped with, for example the tubular element (or sleeve) jutting from the seat.

According to an aspect, the position of the footboard and/or leg rest element with respect to the seat portion of the seat is adjustable, preferably the footboard and/or leg rest element are able to translate and/or rotate in order to change their own position with respect to the seat portion.

According to an aspect, the movable portion of the supporting frame of the footboard and/or leg rest is rotatable with respect to the fixed portion of the frame.

Advantageously, the possibility of adjusting the position of the footrest and/or leg rest, for example by changing the elevation and therefore the position thereof with respect to a horizontal plane, allows the disabled passenger to be comfortably accommodated.

As stated, the present invention also relates to a system for the boarding/disembarking of passengers on/from at least one seat of an amusement ride.

The seat of the system may be the seat described and/or claimed herein, but the use with other seats is also possible.

The system comprises at least one seat for amusement rides having a seat portion and a backrest for accommodating at least one passenger, and at least one transfer trolley comprising moving means for the displacement in correspondence of said at least one seat and at least one seat portion for the passenger who has to be transferred to and from the seat portion of the seat.

An advantage of such a solution is that the passenger, and in particular a disabled passenger, can be effectively transferred to/from the seat of the amusement ride by means of the transfer trolley. In fact, the passenger can be transferred from his/her own wheelchair to the transfer trolley and from it to the seat, quickly, easily and safely.

According to an aspect, the seat portion of the transfer trolley is adjustable in height by adjusting means to adjust the seat portion with respect to the frame of the transfer trolley, so that the seat portion of the transfer trolley can be positioned at a height substantially corresponding to the height of the seat portion of the seat. This way, the operation of boarding/disembarking the passenger on/from the seat can be carried out safely, as there is a substantial correspondence and therefore continuity between the seat portion of the transfer trolley and the seat portion of the seat.

According to an aspect, the transfer trolley can be coupled to the seat by coupling means, preferably in a reversible manner. Preferably, the coupling means, preferably of the reversible type, comprise a first coupling portion arranged on said seat and at least one second coupling portion arranged on said transfer trolley, or vice versa.

Advantageously, since there are the coupling means, the transfer trolley can be temporarily anchored to the seat so that the passenger's transfer operations to/from the seat can be carried out safely without the trolley being subjected to undesirable displacements during these operations.

It should be noted that what is described and/or claimed herein with reference to the seat according to the invention can also be applied to the system of boarding/disembarking passengers according to the invention, and vice versa.

It is a further object of the present invention a method for the boarding/disembarking of passengers on/from a seat, preferably a seat according to the present invention described and/or claimed herein. The method comprises the step of transferring a passenger, in particular a disabled passenger, from his/her own wheelchair or other position onto a transfer trolley in order to subsequently transfer him or her to the seat. In particular, the disabled passenger is transferred to the trolley 80 which provides support for the passenger in a seated position on the seat portion 82.

According to an aspect, the method provides the step of moving the transfer trolley in correspondence of a seat 1 of the amusement ride, for example by moving means.

Alternatively, when the passenger is accommodated on the trolley, the transfer trolley 80 is already in position, in correspondence of the seat 1 of the amusement ride.

According to an aspect, the method also provides the step of adjusting the height of the seat of the transfer trolley so that it substantially corresponds to the height of the seat portion of the seat, and in particular to the height of the front edge thereof. This way the passenger can be transferred safely, for example by sliding from the seat portion of the transfer trolley to the seat portion of the seat, which are basically placed in continuity with each other.

It should be noted that what is described and/or claimed herein in relation to the seat and/or the passenger boarding/disembarking system according to the invention can be applied to the method, and vice versa.

It is a further object of the present invention an amusement ride comprising at least one seat described and/or claimed herein.

BRIEF DESCRIPTION OF THE FIGURES

These and other aspects of the present invention will be clearer by the following detailed description provided herein by way of example only and without limitations, with reference to the accompanying figures, in which.

DETAILED DESCRIPTION OF POSSIBLE EMBODIMENTS OF THE PRESENT INVENTION

Referring to the appended FIGS. 1-9A, a possible embodiment of the seat 1 according to present invention will be described.

According to a possible embodiment, the seat 1 for amusement rides according to the invention comprises a seat portion 2 (or simply seat) and a backrest 3. The term seat portion is referred to the lower portion of the seat intended, in use, to provide support for at least part of the passenger's thighs.

The seat portion 2 is provided with an upper surface 2*a* which may be shaped to provide a comfortable support for the passenger, e.g. the upper surface 2*a* of the seat portion 2 may be shaped substantially to match the shape of the passenger's thighs. In other words, the upper surface 2*a*, instead of being flat may have, for example, a substantially U-shaped area, with two lateral areas substantially elongated so as to be able to accommodate a passenger's thigh at each of them.

Between the two elongated areas there may be a portion or element 30 jutting (protruding) from the upper surface 2*a* of the seat portion 2, e.g. substantially shaped like a horn, or wedge, or dome, or conical or truncated cone or pyramidal and the like, which is arranged substantially in the center region of the seat preferably in the front and center area of the seat, e.g. near the front edge of the seat portion 2 which is substantially opposite the backrest.

Figure 6:
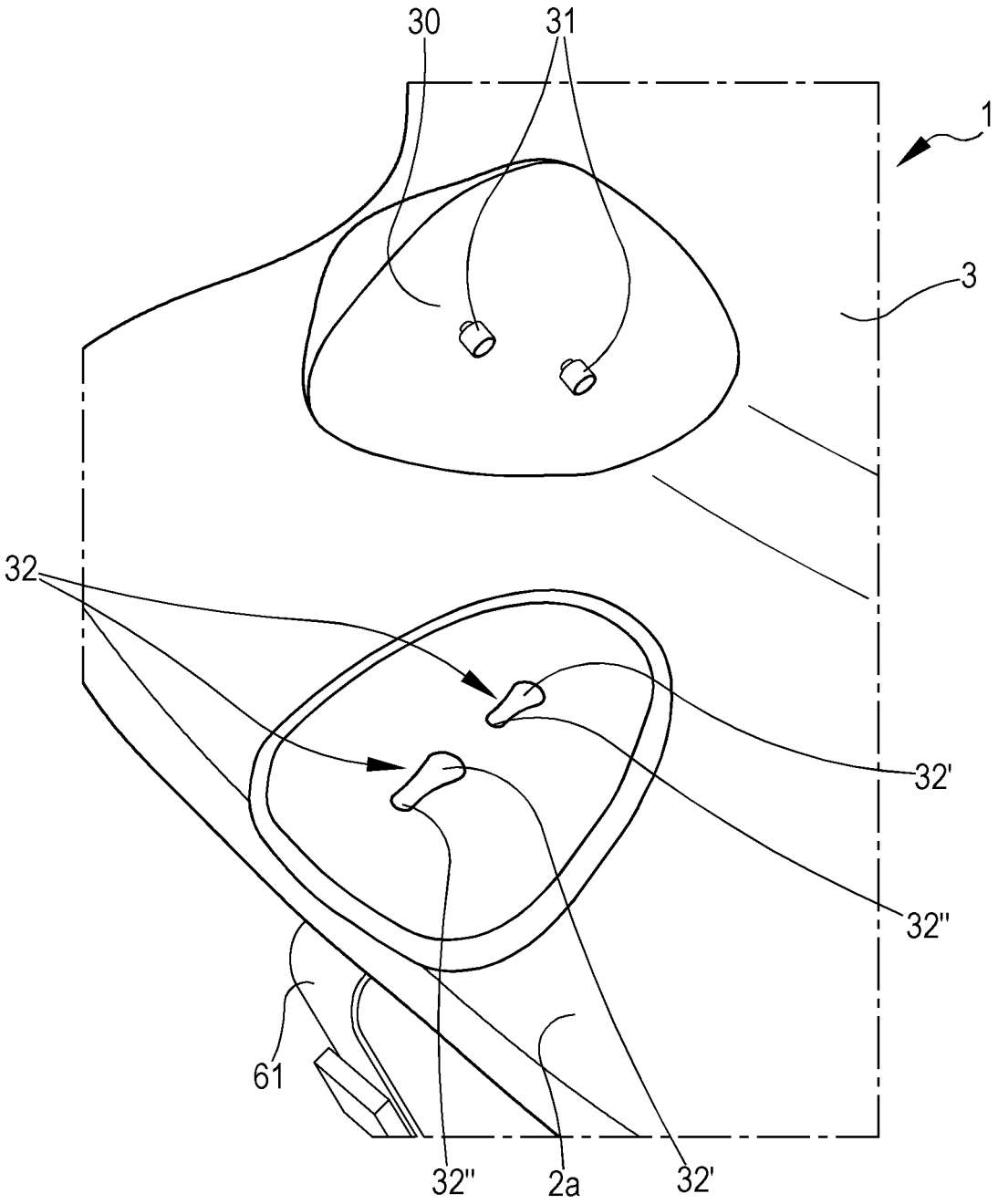
FIG. 6 is a perspective view of a possible embodiment of a seat according to the present invention in which the protruding element 30 is not installed.
Figure 6A:
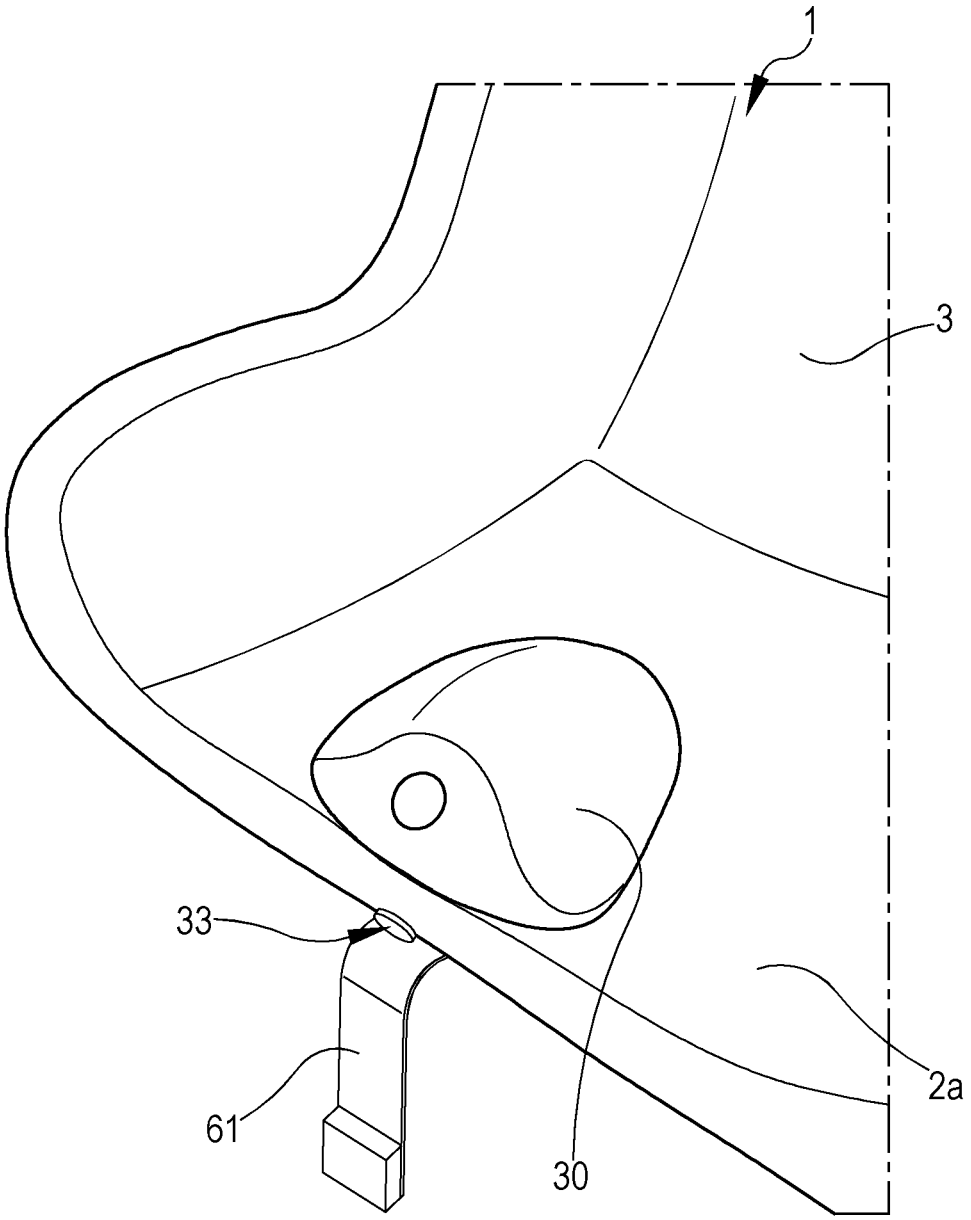
FIG. 6A is a perspective view according to FIG. 6 in which the protruding element 30 is installed.
Figure 7:
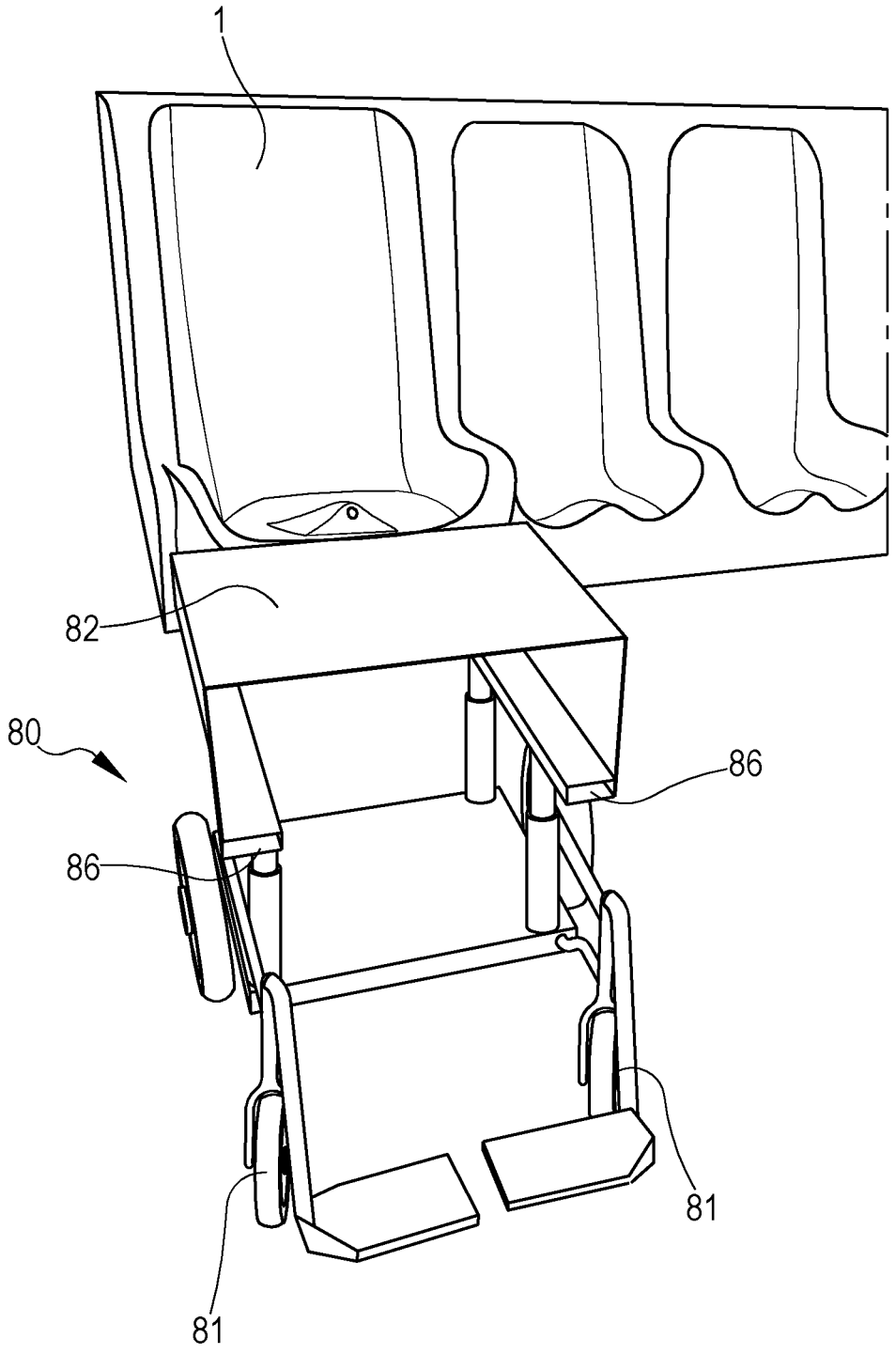
FIGS. 7 and 7A are front and perspective views, respectively, of a system for the boarding/disembarking of a passenger on/from a seat, the system comprising a transfer trolley coupled to the seat and placed in correspondence of the seat.
Figure 7A:
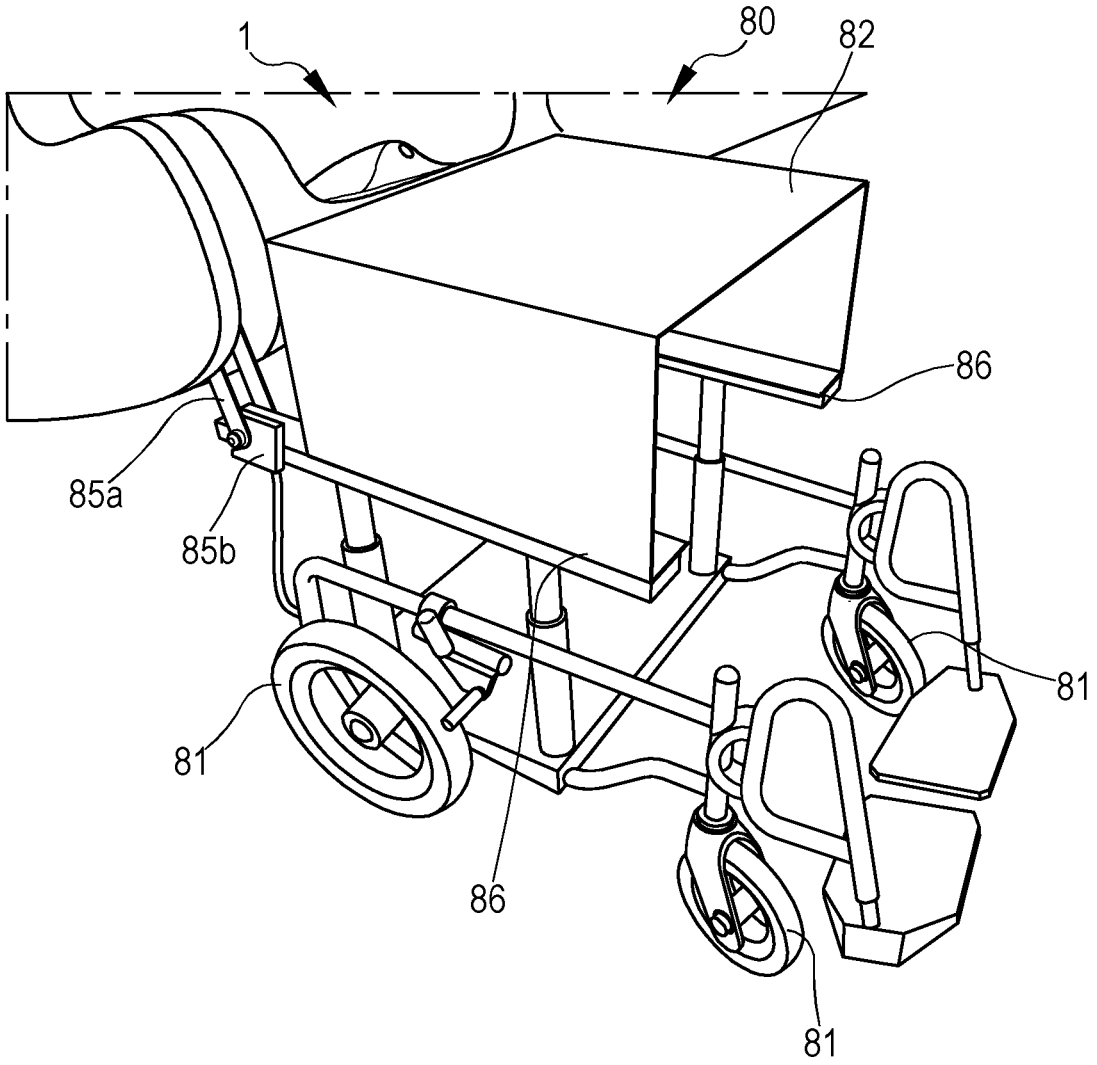
Figure 8:
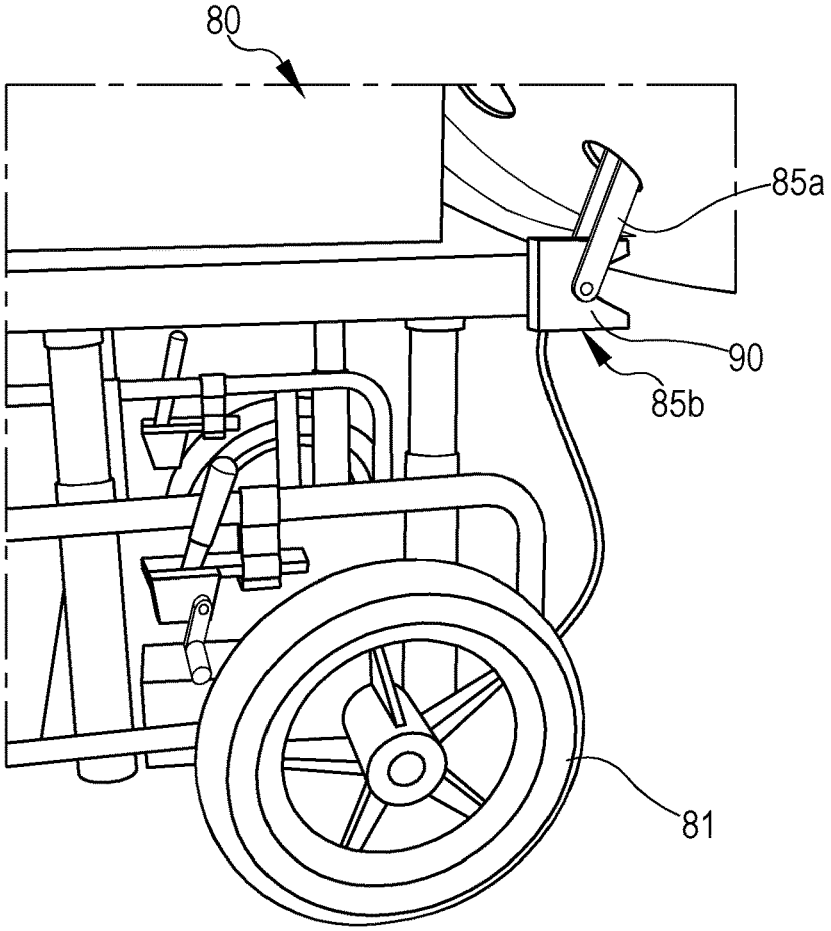
FIGS. 8 and 8A are detailed side view and schematic sectional partial view, respectively, of the transfer trolley coupled to the seat by coupling means of reversible type.
Figure 8A:
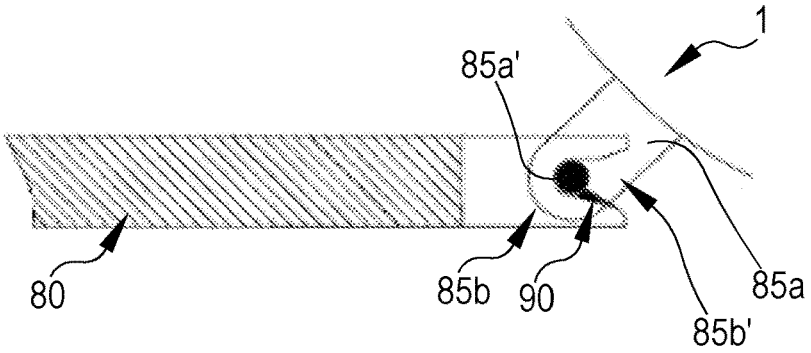

This protruding element 30, arranged between the areas of the upper surface 2*a* which accommodate, in use, the passenger's thighs, is preferably removable (as for example shown in the detail view of FIGS. 6 and 6A).

In particular, this protruding element 30 can be removed when the passenger, and in particular a disabled passenger, is boarded on the seat (as will be seen for example below by using for example a transfer trolley 80) so that he/she can easily slide on the surface 2*a* and reach the appropriate position on the seat 2.

Once the passenger is seated on the seat 1, the protruding element 30 may be constrained to the seat portion 2 by known removable constraining means (for example arranged both on the protruding element and the seat portion, such as for example threaded coupling means (e.g. screws), or by the coupling of complementary parts, or by interference or interlocking of parts, e.g. male-female or snap-fit type couplings.

According to a possible embodiment, one or more pins 31 that are each equipped for example with a head and a portion having reduced section with respect to the head and are jutting from the lower surface of the protruding element 30 (see for example FIG. 6), can cooperate with corresponding housings 32 on the seat portion 2. The housing 32 may be equipped with a variable opening section so as to have an area 32' whose size allows the head of the pin 31 to pass therethrough and, after translation, to reach the second portion of the housing 32 having reduced section 32". Once this reduced section 32" of the opening 32 has been reached, the pin 31, and in particular its head cannot be removed as it is larger than the section of the housing 32" having reduced passage section.

According to a possible embodiment there is an actuating screw or actuating head 33 in the front part of the seat (see for example FIG. 6A), in particular placed substantially at its own front edge, which allows to actuate a selective locking element acting on one or more corresponding pins 31 the protruding element 30 is equipped with.

In other words, this screw 33 which can be actuated manually or by means of a common screwdriver, or similar actuating wrench, allows locking means of the protruding element 30 to be rotated between a retaining position and a releasing position of the protruding element 30.

The constraint of the protruding element 30 on the upper surface 2*a* is such as to withstand any stress due to the contact of the passenger's body with it during the operation of the amusement ride.

The presence of the protruding element 30 contributes to effectively retain (secure) the passenger on the seat, preventing him/her from sliding forward towards the front edge of the seat opposite the backrest 3, during the operation of the amusement ride.

The backrest 3 is provided with a surface 3*a* on which the passenger's back rests. It should be noted that the backrest surface can be suitably configured, for example in a rounded, enveloping shape, to provide comfortable support and lateral retention for the passenger's back.

It should be noted that, according to different possible embodiments, the seat portion 2 and the backrest 3 can be made in one piece, as can be seen for example in the embodiment shown in the figures. Known production techniques for the seat 1 can be used for the manufacture of the seat and in particular the seat portion and the backrest, e.g. by molding.

Alternatively, the seat portion 2 and the backrest 3 can be made of separate pieces and constrained to each other for example by a supporting frame, e.g. formed by one or more bars or structural supporting elements connecting the seat portion 2 and the backrest 3 to one another.

According to an aspect of the present invention, it should be noted that the seat can be configured to receive more than one passenger. In this respect the seat may comprise two or more seat portions 2, 2', 2" and two or more backrests 3, 3', 3" whose number is equal to the number of passengers intended to be supported (as can be seen for example in the embodiment of FIG. 2).

It should be noted that the two or more seat portions and the two or more backrests may be made in one piece and thus have surface continuity which may be provided, in some cases, with separating portions to define and separate from each other the different seat portions and the backrests, or else the seats and backrests may be separated from each other and constrained by known means, such as for example a seat frame comprising one or more connecting bars.

It should be noted from the outset that the seat 1 according to the present invention can be used in different types of amusement rides, and in particular in different types of amusement-ride vehicles in which the seat 1 can make different movements. By way of non-limiting example, the seat 1 can be used in the so-called carousels in which the seat is moved around an axis of rotation, usually vertical, or (as for example can be seen in FIGS. 9 and 9A) can be used in amusement rides 200 in which the seat 1 is moved with swinging motion with respect to the axis, for example a horizontal axis X, to simulate the movement of a seesaw. As stated, other applications are not excluded, for example in amusement rides in which the seat 1 is moved along a track, or along a tower.

As is well known in the field of the amusement rides, and in particular for amusement rides used in funfairs, the seat 1 according to the invention can be equipped with one or more restraining devices 60 to restrain the passenger, for example of a type known in the art. For example, usable restraining means 60 are one or more belts or harnesses intended to come into contact with the passenger's torso, or one or more movable restraining bars, or one or more restraining elements intended to come into contact with at least part of the passenger, or a combination thereof.

In addition, according to possible embodiments, the passenger restraining device may also comprise at least one restraining element equipped with at least one contact surface intended to be placed in contact with at least one part of a passenger, for example with his/her thighs or abdominal or thoracic part.

As stated, the restraining devices may comprise, in addition to or as an alternative to those described above, at least one bar 60 movable between at least one open position (e.g. a raised position where the passenger can access the seat), and at least one closed position (e.g. a lowered position) where the bar or a restraining element placed thereon is in contact with the passenger or is put near the passenger's body thereby restricting his/her possible movements and securing him or her to the seat.

In the embodiment shown in the figures, the seat 1 is equipped with a bar 60 movable between a raised non-operating position and a lowered operating position, once the bar 60 reaches its lowered operating position, it is further secured by a belt 61 which, in use, connects the bar 60 to the seat 1, and in particular to the seat portion 2.

For example, the at least one moving bar 60 is rotatable around at least one axis of rotation. According to different exemplary embodiments, the at least one movable bar can be rotated around an axis of rotation either directly or indirectly, i.e. through the interposition of kinematic connections or joints.

According to other exemplary embodiments, the movement of the movable bar 60 can also be provided as a translation movement (a straight movement), or as a combination of a rotation movement around an axis and a translation movement. It should be noted that according to different possible embodiments, the axis of rotation around which the movable bar can be displaced from the at least one open position to at least one closed position, can be arranged substantially above or below with respect to the seat. For example, the movable bar can be rotated around an axis on the floor in front of the passenger.

Figure 2:
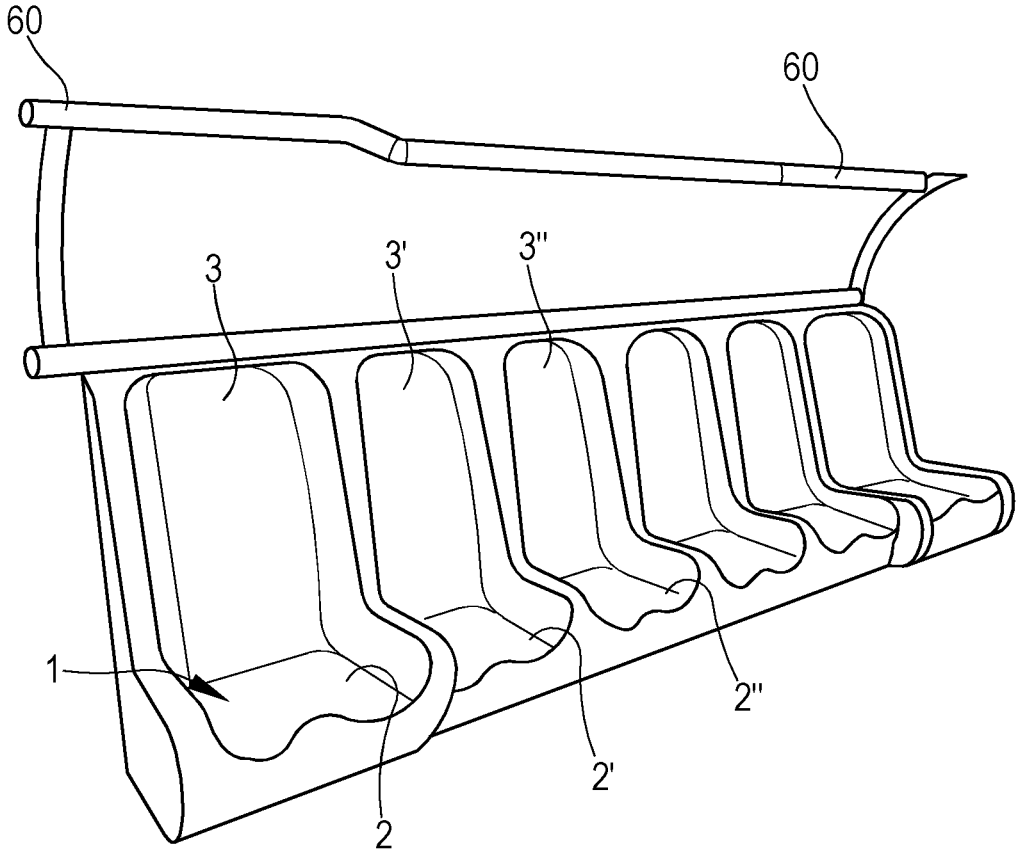
FIG. 2 is a perspective view of a possible embodiment of a seat according to the present invention comprising a plurality of seat portions and a plurality of backrests to accommodate several passengers and passenger restraining means comprising a rotatable bar.
Figure 9:
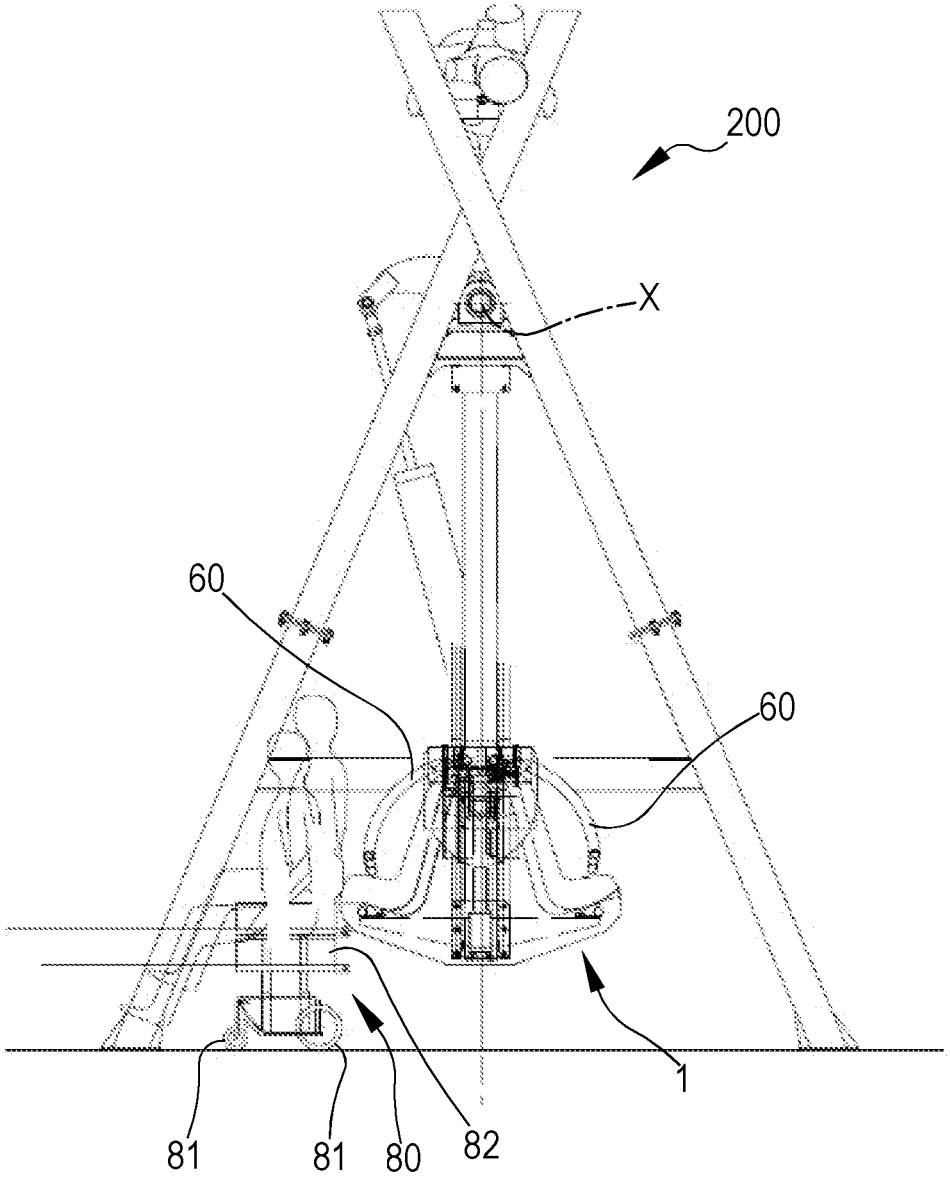
FIG. 9 is a side view of an amusement ride in which a passenger is boarded on the seat by a transfer trolley of the system for the boarding/disembarking of the passenger according to an embodiment of the present invention.
Figure 9A:
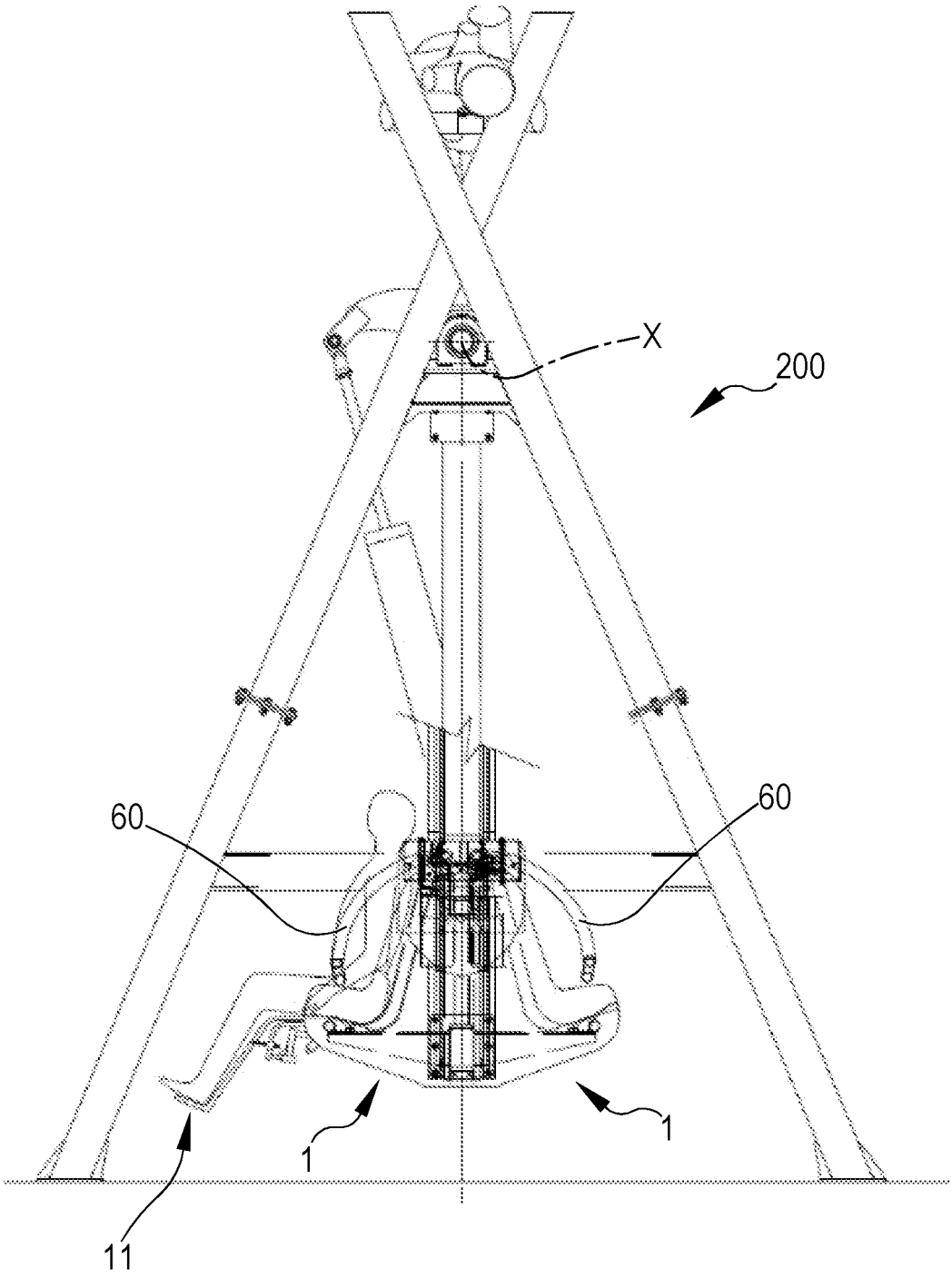
FIG. 9A shows the passenger sitting on the seat 1 in the amusement ride.

According to a further possible embodiment, the at least one axis of rotation of the at least one movable bar 60 is arranged substantially in the upper portion of the passenger seat, and in particular substantially in correspondence of the upper portion of the backrest of the at least one seat (as can be seen for example in FIG. 2 and FIGS. 9 and 9A).

The seat 1 for amusement rides according to the invention comprises at least one footboard 11 and/or at least one leg rest element 12 configured in use to provide support respectively for at least one foot and at least one leg of the passenger.

It should be noted that according to different possible embodiments, the footrest 11 can be made so as to comprise a rigid surface, or a band, or a cushion. For example, the leg rest 12 can also take the same configurations.

Figure 3:
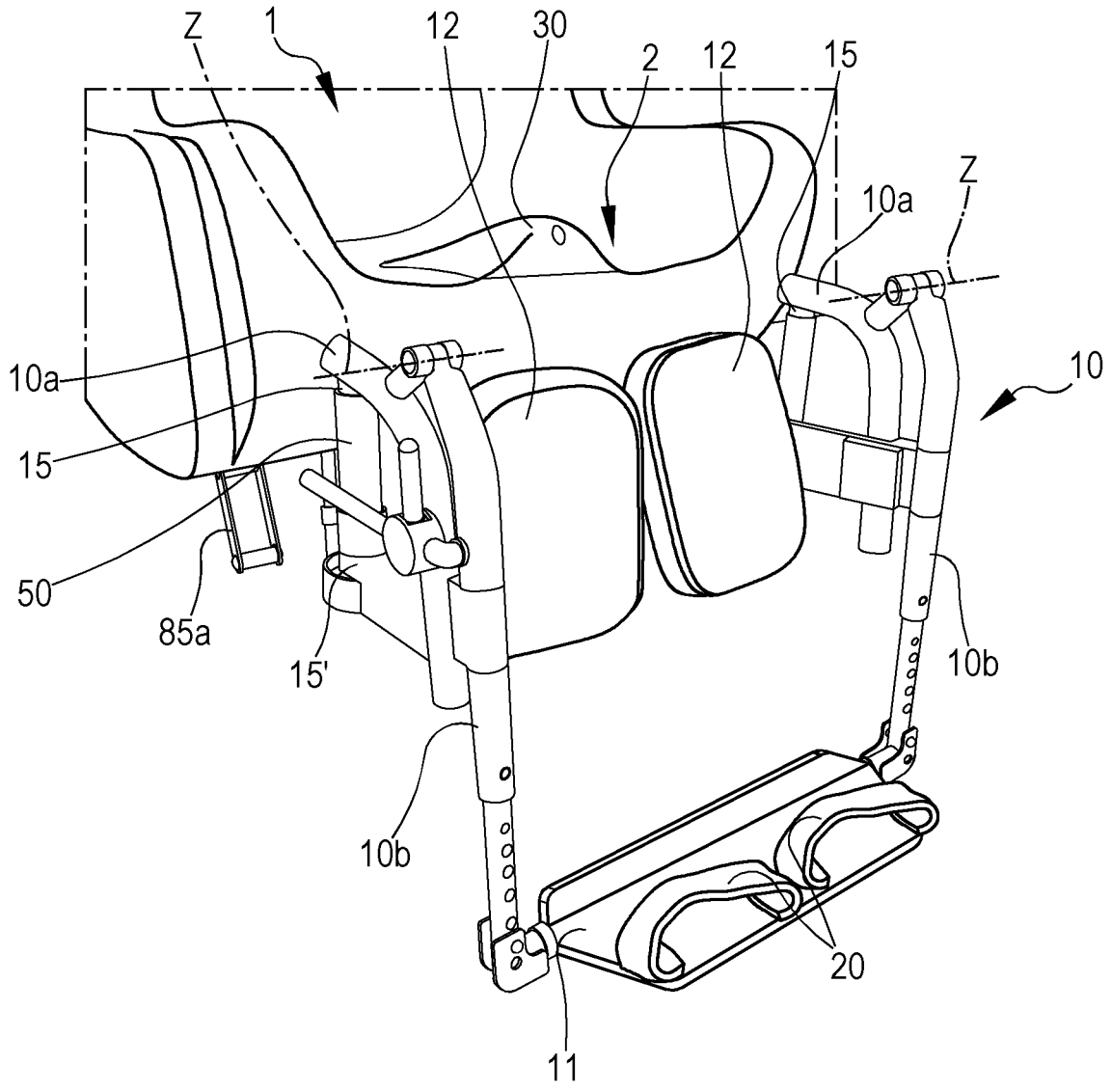
FIG. 3 is a perspective view of a possible embodiment of a seat according to the present invention, in which the footboard and leg rest element are installed.
Figure 4:
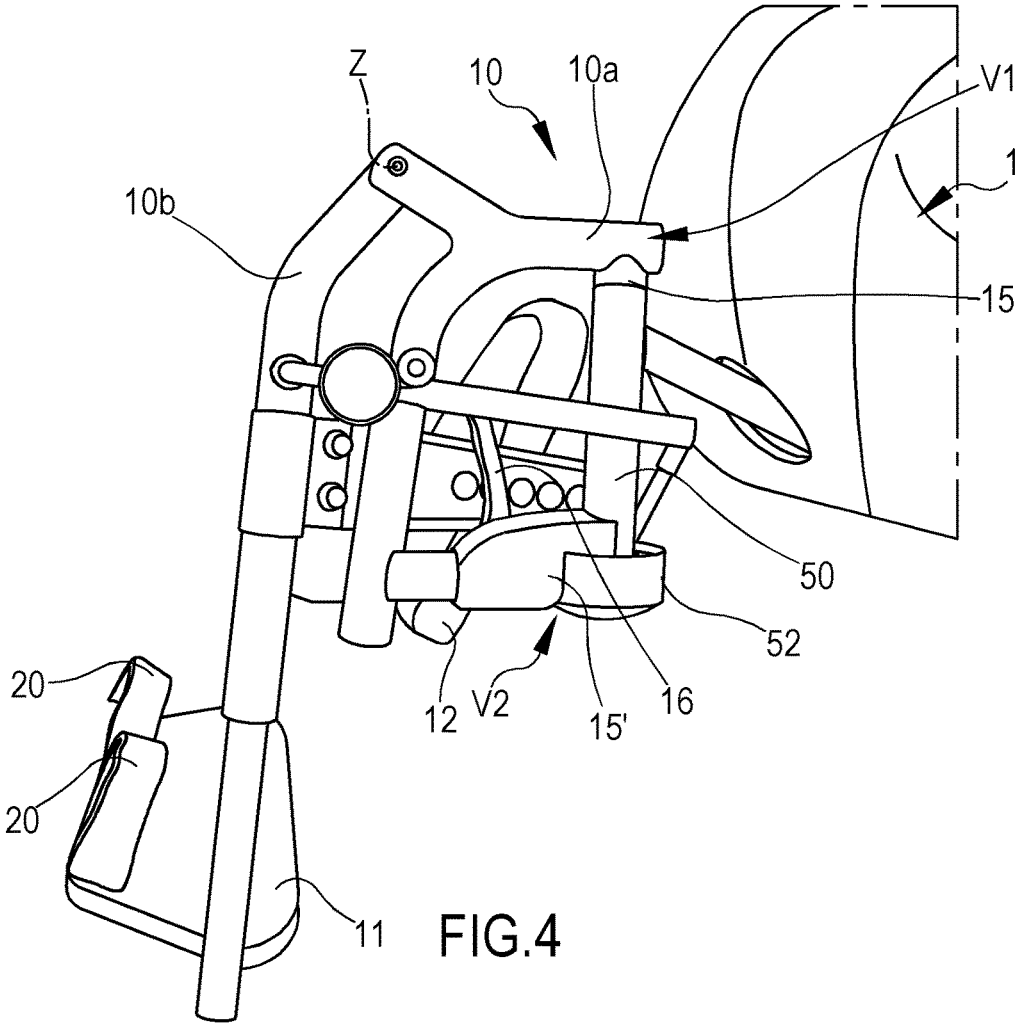
FIG. 4 is a side view of the seat of FIG. 3.

With illustrative reference to FIGS. 3, 4, 4 A, 5, 5 A, a possible embodiment of a footboard 11 and a leg rest element 12 according to the invention with which the seat 1 according to the invention is provided, is described.

The footboard 11 may have substantial planar configuration, and in a preferred embodiment the surface of this footboard 11 intended to be in contact with the passenger's feet is orientable in space so that it can be adapted to the position of the passenger's feet.

It should be noted that here and in the following the expression surface orientable in space means a surface that can be variably oriented with respect to at least one axis.

In an embodiment shown in FIGS. 3, 4, 4A, 5, 5A the footboard 11 is shaped as a single planar support having substantially rectangular shape.

Despite this, possible embodiments (not shown) in which the footboard 11 consists of two distinct planar supports that are independently orientable in space, so that they can be adapted to the lower limbs of a passenger independently of each other, are not excluded.

FIGS. 3, 4, 4A, 5, 5A show a possible embodiment of the leg rest element 12 according to the invention, in which this element comprises two contact portions 12*a*, 12*b* each orientable in space independently of the other and intended to come into contact with at least one rear portion of a passenger's lower limb.

In a further embodiment (not shown), the leg rest element 12 comprises a single contact portion 12 having a surface orientable in space and intended to come into contact with at least one portion of both legs of a passenger.

The footboard 11 and the leg rest element 12 may be made of materials that reach a good compromise between mechanical characteristics and low weight. However, the use of other materials is not excluded.

In a possible embodiment the footboard 11 and/or the leg rest element 12 are removably constrained to the seat 1, preferably to the seat portion 2 of the seat 1 by at least one coupling portion 15, 15' of the footboard 11 and/or leg rest element 12 which, as will be better seen below, cooperates with constraining means 50 that are on the seat.

For example, as shown in FIGS. 1-5A, the seat may comprise constraining means 50 of reversible type for the connection to this coupling portion 15, 15' of the footboard 11 and/or leg rest element 12.

Preferably, these constraining means of the seat are intended to cooperate with a corresponding coupling portion 15, 15' of the footboard 11 and/or the leg rest element 12 and are of the type of interference of parts, interlocking of parts, shape-coupling, or a combination thereof.

As shown for example in FIGS. 1, 3, 4, 4A, 5, 5A, according to a possible embodiment, the constraining means 50 of reversible type may comprise jutting elements 50 which jut from the seat 1, and in particular from the lower portion of the seat portion 2, whose body mainly extends in a longitudinal direction, and which have a longitudinal cavity 51.

In a preferred embodiment, the jutting constraining elements 50 are metal elements substantially tube shaped and with circular section (e.g., sleeve-shaped), although additional geometric shapes, such as jutting constraining elements having polygonal cross-section are not excluded.

According to a possible embodiment, the coupling portion 15 of the footboard 11 and/or leg rest element 12 has a shape complementary to the shape of the opening 51 of the jutting element 50 and is adapted to be inserted into this cavity for a removable interlocking or interference shape-coupling.

In spite of this, it should be noted that the constraining means 50 and the coupling portion 15, 15' intended to cooperate therewith can be all configured according to further alternative shapes to cooperate with each other in order to achieve a reversible coupling with each other.

For example, the coupling portion 15, 15' can be configured to be substantially complementary to the constraining means 50. For example, the connection may be of male-female or snap-fit type, with at least one coupling portion at least partially inserted into a housing of the seat constraining means 50, or vice versa.

According to an aspect of the present invention, the constraining means 50 of the seat and in particular the tubular element 50 forms a housing 51 (e.g. a circular cavity) adapted to receive at least part of the coupling portion 15, or vice versa, so as to achieve a reversible coupling between them.

It should be noted that the term "housing" is used herein to denote at least one portion of the constraining means 50 intended to receive, or to hook, at least part of a first coupling portion 15, 15' which is preferably protruding, or vice versa.

In a possible embodiment, as shown for example in FIGS. 3, 4, 4A, 5, 5 A, the at least one footboard 11 and/or the at least one leg rest element 12 comprise a supporting frame 10 which is constrained, preferably in a removable manner, to the seat 1, preferably to the seat portion 2 of the seat, preferably by the jutting constraining means 50.

As for example shown in FIGS. 3, 4, 4A, 5, 5A, according to a possible embodiment, the frame 10 is a supporting structure formed as an elongated arm, and when in use, i.e. when placed in connection with the seat portion 2, its body extends mainly in a longitudinal direction from that seat portion 2 preferably towards the ground.

According to an aspect, the frame 10 acts as a structural support for the at least one footboard 11 and/or the at least one leg rest element 12, which are supported by the frame 10.

The coupling portion 15 can be arranged, for example, in correspondence of the end portion of this frame 10 and is adapted to be coupled to the cavity 51 of the jutting constraining element 50, preferably by interlocking or shape interference fit.

For example, the coupling portion 15 may comprise a pin, and in general a protruding member, configured to be at least partially inserted into a housing or cavity 51 of the constraining means 50 of the seat, for example in the tubular member 50 having cavities 51.

In a preferred embodiment, as shown for example in FIGS. 3, 4, 4A, 5, 5A, the supporting frame 10 comprises a fixed portion 10*a* configured to be constrained to the seat 1, preferably in a removable manner, and a portion 10*b* movable with respect to the fixed portion 10*a*.

The fixed portion 10*a* comprises the coupling portion 15 and is adapted to be inserted into the cavity 51 of the jutting constraining element 50 at least at a constraint point VI located at the connection point between the coupling portion 15 and the cavity 51 of the constraining element 50 jutting from the seat.

The frame 10, and in particular the fixed portion 10*a*, may further comprise a second coupling portion 15' which comprises a hooking/unhooking lever 16 movable between at least one open position and at least one closed position and adapted to hook a portion of the jutting constraining element 50.

Figure 1:
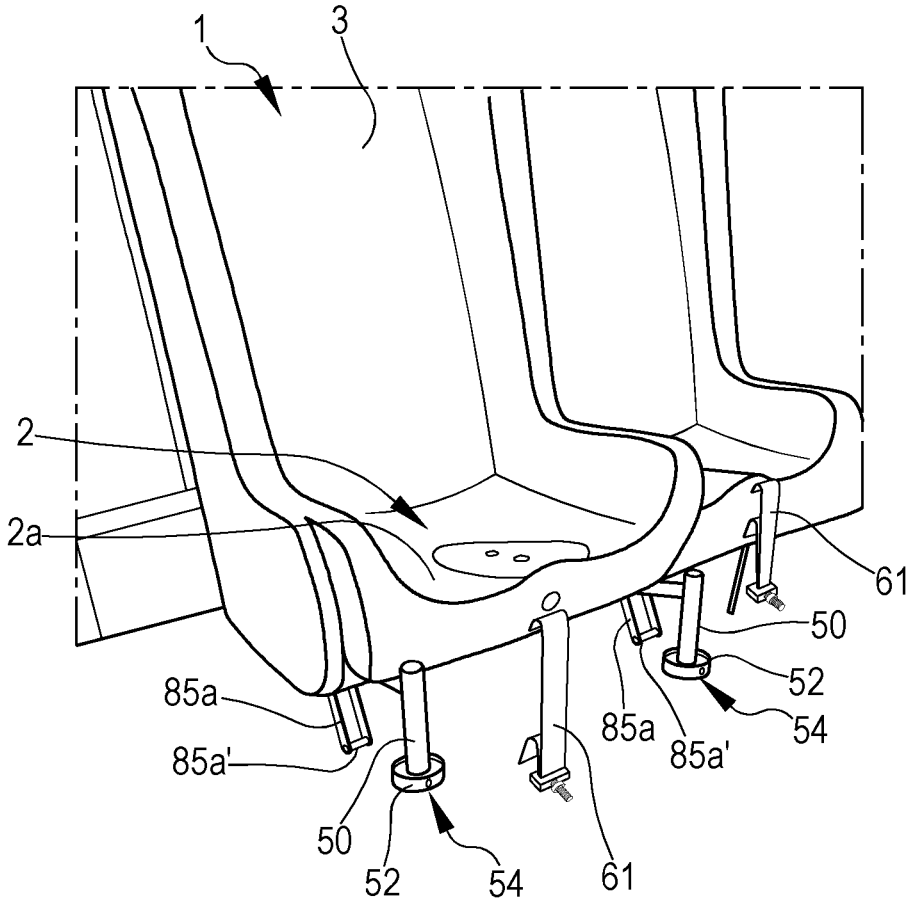
FIG. 1 is a perspective view of a possible embodiment of a seat according to the present invention, in which the footboard and leg rest element are not installed.

As for example shown in FIGS. 1, 3, 4, 4 A, 5, 5 A, the constraining element 50 may comprise a protruding portion 52, e.g. of circular shape, adapted to be hooked by the lever 16 of the second coupling portion 15'.

The second coupling portion 15' further comprises a pin 18 adapted to cooperate, e.g. by interlocking, with a corresponding housing or opening 54 made in the protruding portion 52 of the jutting constraining element 50. The pin 18 can be controlled to be retracted (thus allowing it to be removed) from the opening 54 by means of the lever 16.

Figure 4A:
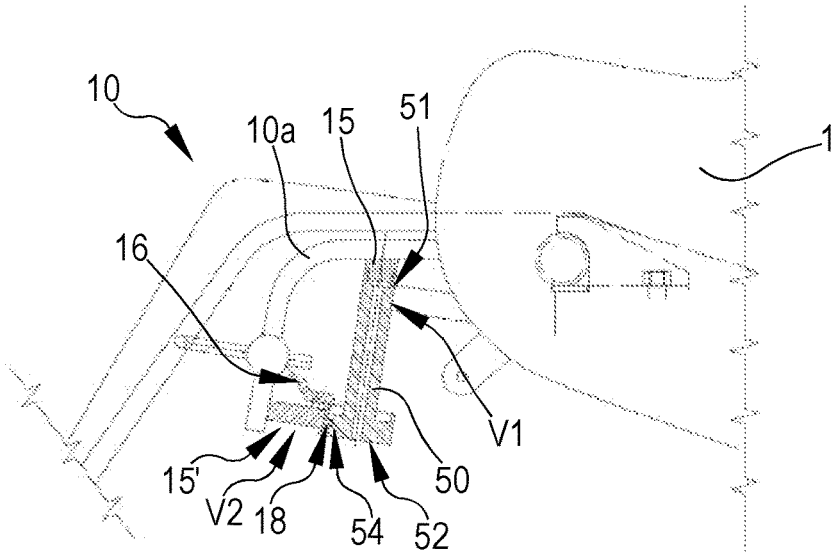
FIG. 4A is a schematic sectional view of FIG. 4.

In the closed position of the lever 16, the pin 18 is inserted in the opening 54 of the protruding portion 52, and the lever 16 is hooked to an edge of this protruding portion 52, as can be seen for example in the schematic sectional view of FIG. 4A.

In other words, according to a possible embodiment, the frame 10, and in particular the fixed portion 10*a*, is adapted to be constrained to the jutting constraining element 50 at least at two constraint points VI, V2, in which the first constraint point VI is identified by the connection of the coupling portion 15 to the cavity 51 of the jutting constraining element 50 and the second constraint point V2 is identified by the connection between the second coupling portion 15' and the protruding portion 52 of the jutting constraining element 50.

Figure 5:
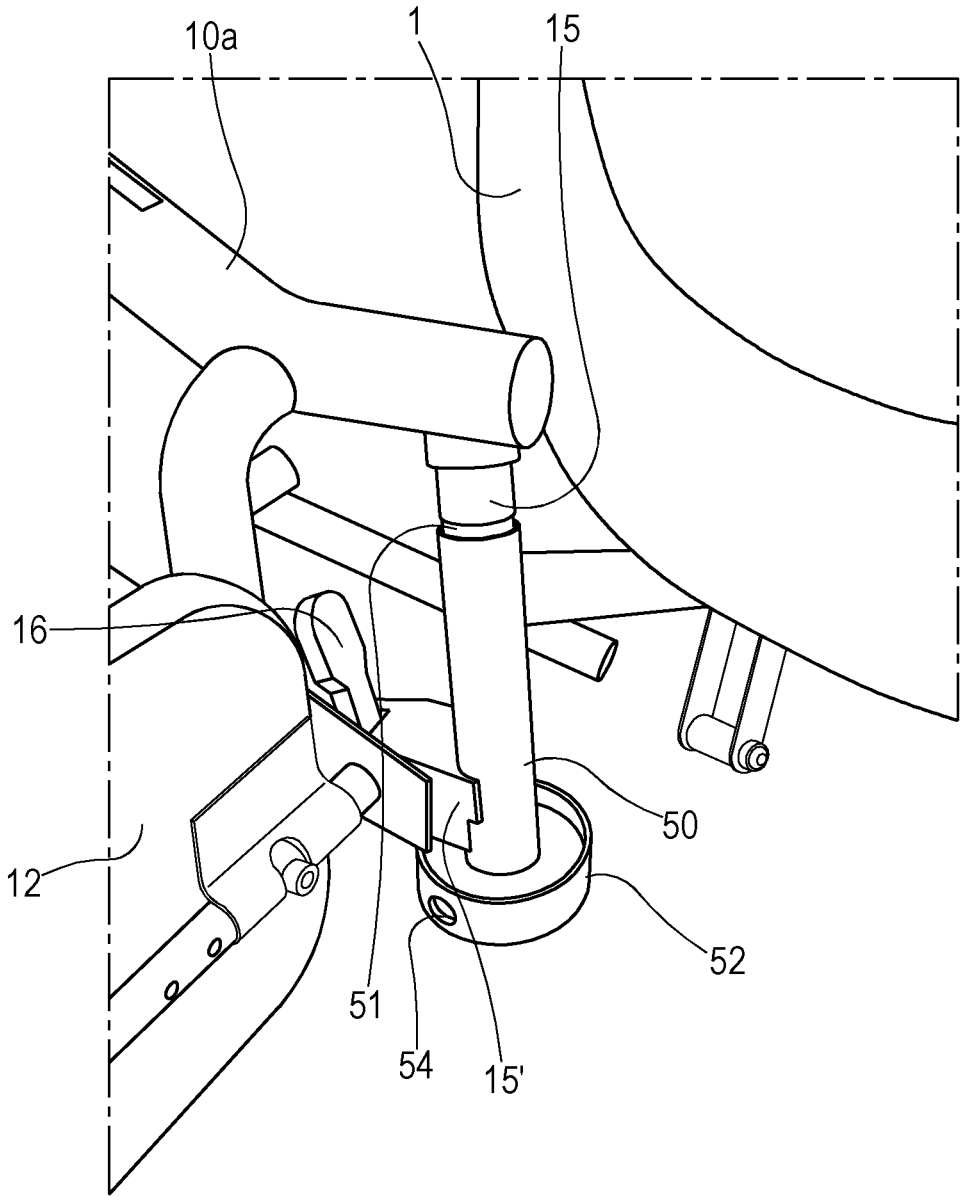
FIG. 5 is a detail view of a step of installing the footboard and leg rest element on the constraining means of the seat.
Figure 5A:
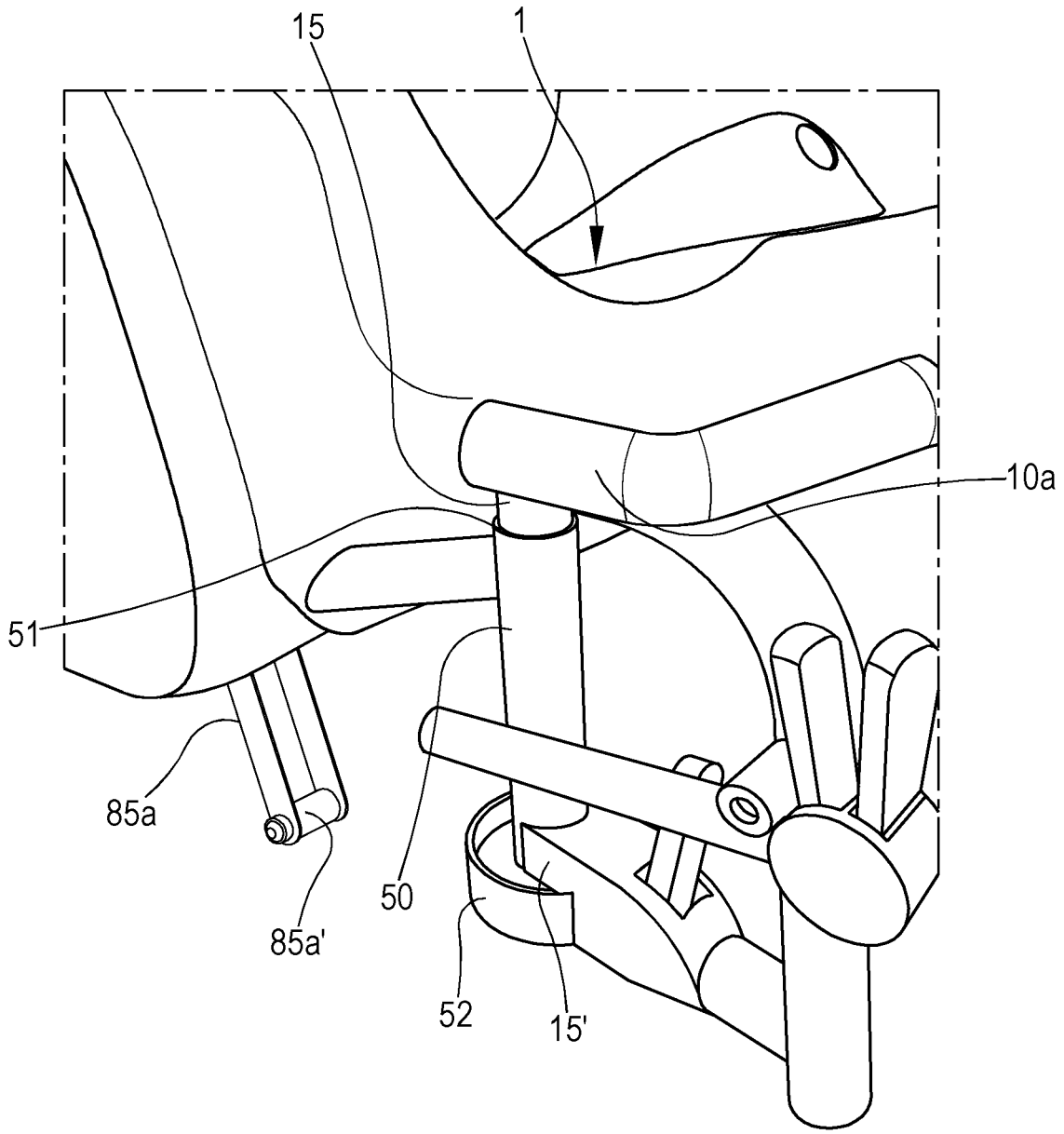
FIG. 5A is a view according to FIG. 5 following the anti-clockwise rotation (starting from the position of FIG. 5) of the footboard and leg rest element on the constraining means of the seat.

It should be noted that the configuration of the constraining element 50 of the seat 1, which is essentially tubular in shape and has a cavity 51 intended to receive at least one corresponding coupling portion 15 of the frame 10 and in general of the footboard 10 and/or leg rest element 12, also allows the frame 10 to be rotated around an axis corresponding to the axis of the tubular portion of the constraining element 50 (see for example the comparison of positions between FIGS. 5 and 5A). The rotation (for example counterclockwise if starting from the position of FIG. 5 to reach the position of FIG. 5A) allows the frame 10 and then the footboard 11 and/or the leg rest element 12 to be easily installed starting from a position in which they are placed laterally with respect to the seat (see for example FIG. 5). The frame 10 is subsequently rotated to reach the predetermined position where they are placed substantially in front of the seat 1 (see for example FIG. 5A). This predetermined position is identified, for example, by the housing 54 located on the constraining element 50 which is reached by the pin 18 thereby causing its coupling (as a result of the rotation).

In an embodiment, the at least one footboard 11 and/or the at least one leg rest element 12 are arranged on the movable portion 10*b* of the supporting frame 10, which is preferably rotatable (around an axis Z, see for example FIGS. 3 and 4) with respect to the fixed portion 10*a*. The rotation allows the footboard 11 and/or leg rest element 12 to be raised and thus lifted towards the horizontal position according to the passenger's needs.

Thanks to the footboard 11 and/or the leg rest element 12 the lower limbs of the passenger, and in particular of the disabled passenger, can advantageously be effectively and safely supported in the appropriate way during the movement of the amusement ride.

It should also be noted that according to an aspect, the seat 1 according to the invention further comprises restraining devices 20 configured to secure a passenger's foot and/or leg to the at least one footboard 11 and/or the leg rest element 12. The restraining means 20 may include a strap, band, restraining surface or wall, e.g. movable.

In a possible embodiment, as shown for example in FIGS. 3 and 4, the restraining means 20 comprise a foot strap and/or a leg strap.

These foot and leg restraining means prevent these parts of the passenger's body from undesirably moving away from the respective footboard 11 and/or leg rest element 12 during the movement of the amusement ride.

As stated, the present invention also relates to a system for the boarding/disembarking of passengers on/from at least one seat of an amusement ride.

It should be noted that the seat that can be used in the system for the boarding/disembarking of passengers on/from at least one seat of an amusement ride and in particular with the transfer trolley 80, may be the seat 1 according to the invention described and/or claimed herein, or with other seats known in the art and used in amusement rides.

The system for passenger boarding/disembarking, shown for example in FIGS. 7, 7A, 8, 8A, comprises at least one amusement-ride seat 1 having a seat portion 2 and a backrest 3 to accommodate at least one passenger, preferably a seat 1 described and/or claimed herein, and at least one transfer trolley 80.

The transfer trolley 80 comprises moving means 81, possibly motorized, such as one or more wheels (or similar elements allowing easy displacement on a surface). It should be noted that, according a possible embodiment, the transfer trolley 80 is equipped with four wheels 81, as for example in the embodiment shown in the figures. At least one wheel, and preferably two wheels, can be rotatable and thus allow the steering and in general direction changes of the transfer trolley 80.

The displacement of the trolley 80 allows the transfer trolley 80 to be arranged in correspondence of said at least one seat 1 and can be carried out, as stated, by integral moving means, such as a motor, or with the help of staff who will displace the transfer trolley.

The transfer trolley 80 comprises at least one seat portion 82 provided with an upper surface 82*a* intended to accommodate the passenger, and in particular a disabled passenger.

According to a possible embodiment the transfer trolley 80 is not equipped with a backrest and therefore the seat is not perimetrically delimited so that the passenger can be temporarily accommodated on the seat portion 82 of the transfer trolley that, once placed in correspondence of the seat 2, allows the passenger to be transferred to the seat portion 2 of the seat 1 without obstacles.

By using the seat surface 82 of the transfer trolley 80, the passenger can be transferred to the seat portion 2 of the seat 1 quickly and safely. It should be noted that the passenger, and in particular the disabled passenger, can be transferred on the transfer trolley 80 from a wheelchair or other passenger's displacement or supporting apparatus.

The transfer of the passenger on the transfer trolley may take place in a remote position with respect to the seat 1, in fact, the transfer trolley 80, through the moving means 81, will then allow to reach a position where the trolley is in correspondence of the seat and thus the position in which it provides continuity of the seating surface 82 of the trolley with the surface 2*a* of the seat portion 2 of the seat 1.

However, it is not excluded that the disabled passenger may be transferred from his/her wheelchair to the transfer trolley 80 even when the latter is already in the position next to or in correspondence of the seat 1 to which the passenger is to be transferred.

The height of the seat portion 82 of the transfer trolley 80 is adjustable by adjusting means to adjust the seat portion 82 with respect to the frame of the transfer trolley, so that the seat portion 82 of the transfer trolley can be positioned at a height substantially corresponding to the height of the seat portion 2 of the seat.

Furthermore, according to an aspect of the present invention, the seat portion 2 may also be translatable, preferably in the plane (e.g. by means of one or more rails 86), with respect to the trolley frame. This translation, once the transfer trolley is next to the seat 1, allows the seat portion 82 of the trolley to reach the position in contact with the seat 1 and then with the seat portion 2 thereof, thus determining continuity between the two surfaces.

The position adjustment means of the seat portion 82 may comprise, for example, a knob or handle, or other preferably manually actuated element, adapted to be actuated by a user in order to control appropriate height-adjustment elements such as for example a piston or rack driving mechanism, or similar means for desirably controlling the relative movement of the seat portion with respect to the frame of the transfer trolley 80.

For example, the seat portion may be moved to an upright position while keeping the surface 82*a* of the seat portion 82 substantially parallel to the ground, preferably parallel to the ground.

According to an aspect of the present invention, the transfer trolley 80 can be coupled to the seat by coupling means 85*a*, 85*b*, preferably in a reversible manner. In other words, when the transfer trolley 80 is placed next to the seat 1 and with the seating surface 82 of the transfer trolley at a height substantially equal to the height of the seat portion 2 of the seat 1 (and in particular of the front edge thereof), the trolley can advantageously be reversibly coupled (anchored) to the seat thereby preventing the trolley during passenger transfer operations from undergoing undesirable displacements that could jeopardize the safety in performing such operations.

Of course, the transfer trolley 80 may be equipped with braking systems that contribute to prevent the unwanted displacement of the trolley itself when performing the transfer of the passenger from the wheelchair to the trolley or from the trolley to the seat, and vice versa.

It should be noted that according to possible embodiments, the coupling means 85*a*, 85*b*, preferably of a reversible type, of the transfer trolley 80 to the seat 1 comprise a first coupling portion 85*a* arranged on the seat 1, and in particular at the lower portion thereof below the seat portion 2, and at least one second coupling portion 85*b* arranged on the transfer trolley 80, or vice versa.

Advantageously, the reversible type coupling is such that the seat 1 and the trolley 80 can be caused to be released and thus decoupled from each other, preferably as a result of the intervention of an operator, so that at the end of the passenger transfer operations the transfer trolley can be moved away from the amusement ride to allow the normal operation thereof.

According to a possible embodiment, as can be seen for example in the appended figures, the seat comprises two coupling portions 85*a* jutting from the lower surface of the seat and, in particular, below the seat 2. Such coupling portions, for example made of metal material, support two small arms or bushings 85*a*' which, as will be better seen below, are intended to be housed in a corresponding housing 85*b*' of the coupling portion 85*b* which is on the transfer trolley.

In fact, according to an aspect, the second coupling portion 85*b* is adapted to receive, or hook, at least part of the first coupling portion 85*a*, or vice versa. According to a possible embodiment, as for example shown in the figures, the second coupling portion 85*b* which is on the trolley comprises a housing 85*b*' which is formed by two elements jutting from the frame and substantially U-shaped and is intended to receive within itself at least part of the bushing or small arm 85*a*' of the first coupling portion 85*a* present on the seat 1 (as for example shown in the schematic view of FIG. 8A).

It should also be noted that a safety element 90 is used to prevent the undesirable decoupling of the first and second coupling portions and in particular the bushing or small arm 85*a*' from the housing 85*b*'. For example, a safety element or hook 90 may be arranged (e.g., in a movable or deformable manner) so as to allow the bushing or small arm 85*a*' to be inserted into the housing 85*b*', but so as to prevent it to be moved away.

Only as a result of the release of the safety element 90, for example controlled by a user through a handle or other actuating device for example connected to a wire that transmits the actuation to the safety element 90, is it possible to cause the displacement or deformation of the safety element 90 and allow the trolley 80 to be decoupled from the seat 1, with the small arm or bushing 85*a*' coming out of the housing 85*b*'.

As stated, on the seat 1 there may be two coupling portions 85*a* intended to cooperate with two respective coupling portions 85*b* that are on the trolley 80.

According to an aspect of the present invention and for example as described above, the first coupling portion 85 arranged on the seat 1 is complementary configured for the coupling, preferably of reversible type, to the second coupling portion 85*b* arranged on the transfer trolley 80, or vice versa.

Although reference has been made to a straight portion intended to be received in a substantially U-shaped housing, it should be noted that the coupling means 85*a*, 85*b* may be configured according to further alternative shapes in order to cooperate with each other so as to achieve reversible coupling therebetween.

For example, the first and second coupling means 85*a*, 85*b* may be configured to be substantially complementary to one another. For example, the connecting means may be of male-female or snap-fit type, with at least one coupling portion 85*a* at least partially inserted within a second coupling portion 85*b*.

According to an aspect of the present invention, the second coupling portion 85*b* forms a housing adapted to receive at least part of the first coupling portion 85*a*, or vice versa, so as to achieve a reversible coupling therebetween.

It should be noted that the term "housing" is used herein to denote at least one coupling portion 85*b* intended to receive, or to hook, at least part of a first coupling portion 85*a* which is preferably protruding, or vice versa.

It should also be noted that, in order to ensure maximum safety of the disabled passenger temporarily accommodated on the transfer trolley, the latter may be equipped with at least one footboard 87 (as for example can be seen in the embodiment depicted in the figures). The footboard may be single or there may be two footboards 87, as for example in the embodiment shown in the figures. It should be noted that in addition to or as an alternative to the footboard 87, the transfer trolley 80 may be equipped with at least one leg rest element configured in use to provide support for a leg of the passenger carried on the transfer trolley 80. In this case too, the leg rest element can be single or there can be two separate leg rest elements, each dedicated to support one leg of the passenger.

Obviously, according to possible embodiments, the transfer trolley 80 may be provided with restraining means configured to secure the passenger's foot and/or leg to at least one footboard and/or leg rest element (if any) of the transfer trolley 80, these retaining means, even if not shown in the attached figures, may comprise for example a foot strap and/or a leg strap.

The steps of the method for boarding/disembarking passengers on/from at least one seat of an amusement ride will now be described by way of example and without limitation. It should be preliminarily noted that the use of the system for boarding/disembarking passengers by means of a transfer trolley 80 according to the present invention, as stated, is not limited to be used with the seat 1 described and/or claimed herein according to the present invention.

The method for the boarding/disembarking of passengers on/from a seat 1, preferably a seat 1 according to the present invention, comprises the step of transferring a passenger, in particular a disabled passenger, from his or her own wheelchair or other position onto the transfer trolley 80. In particular, the disabled passenger is transferred to the trolley 80 which provides support for the passenger in a seated position on the seat portion 82. As mentioned, the transfer trolley 80 is moved for example by moving means 81 in correspondence of a seat 1 of the amusement ride, alternatively the transfer trolley 80 is already in position, in correspondence of the seat of the amusement ride 1 when the passenger is accommodated on the trolley 80.

According to an aspect, the method comprises the step of coupling (anchoring) the transfer trolley to the seat 1 by the cooperation of the coupling portions 85*a*, 85*b*, as for example described above.

According to an aspect, the method provides the step of adjusting the height of the seat portion 82 of the transfer trolley by adjusting means of the seat portion 82 with respect to the frame of the transfer trolley, so that the seat portion 82 of the transfer trolley is at a height substantially corresponding to the height of the seat portion 2 of the seat 1. At this point the passenger can be easily and safely transferred from the transfer trolley 80 to the seat 1.

Once the passenger has been transferred to the seat, the trolley 80 is decoupled from the seat and displaced so as to not interfere with the movement of the amusement ride.

According to an aspect, the seat 1 comprises at least one footboard 11 and/or at least one leg rest element 12 so as to provide support for at least one foot and at least one leg of the passenger, respectively. The seat 1 may further comprise restraining means 20 configured to secure the foot and/or leg of the passenger to at least one footboard 11 and/or at least one leg rest element 12. In this case, the passenger is further secured so that the restraining means, for example by a belt or a strap or similar elements, can secure the foot and/or leg of said passenger to at least one footboard 11 and/or leg rest element 12.

It should be noted that, according to an aspect, if the footboard and/or the leg rest element 12 are removable, such element(s) are constrained to the seat 1 before it is received on the seat or may be constrained to the seat, for example by constraining means 50 as described above, after the passenger has been transferred to the seat.

However, embodiments are not excluded in which the transfer trolley 80 and the footboard 11 and/or the leg rest element 12 are shaped so that they do not interfere with each other, and therefore the transfer trolley in the passenger transfer position can be coupled even if the footboard 11 and/or the leg rest element 12 are constrained on the seat.

It should also be noted that according to an aspect, the seat 1 may be equipped with a jutting (protruding) portion or element 30 that juts from the upper surface 2*a* of the seat portion, e.g. substantially shaped like a horn, or wedge, or dome, or conical or truncated cone or pyramidal, and the like. As stated, according to an aspect, said protruding element 30 is removable and the method, according to an aspect of the invention, provides for the step of removing the protruding element 30 before the passenger is boarded on the seat and in particular before the passenger is transferred from the transfer trolley to the seat 1.

According to an aspect of the invention, the method provides that when the passenger is seated on the seat 1, the protruding element 30 may be constrained to the seat portion 2 by known removable constraining means (for example arranged both on the protruding element and the seat portion, such as for example threaded coupling means, e.g. screws, or by the coupling of complementary parts, or by interference or interlocking of parts, e.g. male-female type or snap-fit type couplings.

According to an aspect of the invention, the method provides the step of removing the protruding element 30 before the passenger is disembarked from the seat, and in particular before the passenger is again transferred from the seat 1 to the transfer trolley 80, at the end of the movement of the amusement ride.

According to an aspect, before the movement of the amusement ride has started, the passenger restraining means 60, such as a bar and/or belt known in the art, are moved towards their operating (closed) passenger retaining position.

At the end of the operation cycle of the amusement ride, the passenger can be disembarked from the seat and the method will provide that the steps described above are repeated in reverse and in general by repositioning the transfer trolley in correspondence of the seat so that the passenger can be transferred from the seat to the transfer trolley and from the latter to his/her own wheelchair, possibly by displacing the transfer trolley 80 away from the seat towards the position where the passenger's wheelchair is located.

In the event that the seat 1 is provided with at least one footboard 11 and/or at least one leg rest element 12 of removable type, these components may be released from the seat in order to carry out operating cycles of the amusement ride, for example in the event that it is not necessary to receive disabled passengers on the seat.

The invention claimed is:

1. A seat for amusement rides, the seat comprising:

a seat portion and a backrest to accommodate at least one passenger, wherein the seat portion is provided with an upper surface having a substantially U-shaped area, with two lateral areas, substantially elongated, so as to be able to accommodate a passenger's thigh at each of the two lateral areas, wherein the seat portion is provided with a front edge which is substantially opposite the backrest;

at least one footboard and at least one leg rest element, placed in front of the seat and configured in use to provide support respectively for at least one foot and at least one leg of the passenger;

constraining means of reversible type, which constrain the at least one footboard and the at least one leg rest element to the seat; wherein the constraining means comprise jutting elements which jut from the front edge of the seat portion;

a supporting frame which is constrained, in a removable manner, to the seat portion by means of the jutting elements and is placed in front of the front edge of the seat portion; wherein the at least one footboard and the at least one leg rest element are supported by the supporting frame;

restraining means configured to secure the foot and/or leg of the passenger to the at least one footboard and/or the at least one leg rest element;

at least one protruding element, which juts from the upper surface of the seat portion, and is arranged between the two lateral areas of the upper surface which, in use, accommodate the passenger's thighs;

wherein the at least one protruding element is arranged in a front and center area of the upper surface of the seat portion, near the front edge of the seat portion;

wherein the at least one protruding element is removable and is constrained to the seat portion by removable constraining means.

2. The seat of claim 1, wherein the footboard and the leg rest element is removably constrained to the seat.

3. The seat of claim 1, wherein the constraining means is of a type of interference of parts, interlocking of parts, or shape-coupling, or a combination thereof.

4. The seat of claim 3, wherein the constraining means comprise at least one substantially tubular element jutting from the seat.

5. The seat of claim 3, wherein the at least one footboard and the at least one leg rest element comprises at least one coupling portion which cooperates, in a reversible manner, with the constraining means of the seat.

6. The seat of claim 5, wherein the constraining means of the seat are adapted for receiving, or hooking, at least part of the at least one coupling portion, or vice versa.

7. The seat of claim 1, wherein the position of the at least one footboard and of the at least one leg rest element is adjustable with respect to the seat portion, wherein the at least one footboard and the at least one leg rest element are able to translate and/or rotate in order to change their own position with respect to the seat portion.

8. The seat of claim 1, wherein the supporting frame comprises a fixed portion configured to be constrained, in a removable manner, to the seat portion and a movable portion able to be moved with respect to the fixed portion, wherein the at least one footboard and the at least one leg rest element are arranged on the movable portion of the supporting frame.

9. The seat of claim 8, wherein the movable portion of the supporting frame is rotatable with respect to the fixed portion.

10. The seat of claim 1, wherein the restraining means comprise at least one foot strap and/or one leg strap.

11. The seat of claim 1, further comprising at least one retaining element to retain a passenger's body on the seat, the at least one retaining element being selected from at least one movable bar, at least one belt, or a combination thereof.

12. The seat of claim 1, wherein the removable constraining means are arranged both on the at least one protruding element and the seat portion.

13. The seat of claim 12, wherein the removable constraining means are selected from between: threaded coupling means, coupling of complementary parts, interference of parts, and interlocking of parts.

14. The seat of claim 1, wherein the at least one protruding element has a tapered shape, extended from a larger base, which is placed on the upper surface of the seat portion, to a narrower top.

15. The seat of claim 1, wherein the removable constraining means comprise:

one or more pins that are each equipped with a head and a portion having reduced section with respect to the head, and are jutting from a lower surface of the at least one protruding element, and corresponding housings on the seat portion able to cooperate with the pins;

wherein each housing is equipped with a variable opening section, so as to have a first area whose size allows the head of the pin to pass therethrough and, after translation, to reach a second area of the housing having reduced section, wherein the head of the pin is larger than the reduced section of the second area.

16. The seat of claim 15, wherein the removable constraining means comprise an actuating screw or an actuating head, placed at the front edge of the seat portion and able to actuate a selective locking element acting on the pins.

17. The seat of claim 1, wherein the jutting element has a longitudinal cavity, and the at least one coupling portion has a first shape complementary to a second shape of the longitudinal cavity of the jutting element and is adapted to be inserted into the longitudinal cavity for a removable interlocking or an interference shape-coupling.

* * * * *